US005505636A

United States Patent [19]

Blum

[11] Patent Number: 5,505,636

[45] Date of Patent: Apr. 9, 1996

[54] CATV POWER TAPPING DEVICE

[75] Inventor: Theodore Blum, Dallas, Tex.

[73] Assignee: Reltec Corporation, Cleveland, Ohio

[21] Appl. No.: 328,904

[22] Filed: Oct. 25, 1994

[51] Int. Cl.[6] ..... H01R 9/07

[52] U.S. Cl. ..... 439/579; 439/814

[58] Field of Search ..... 439/578–585, 439/810–814, 394

[56] References Cited

U.S. PATENT DOCUMENTS

| | | | |
|---|---|---|---|
| 2,805,399 | 9/1957 | Leeper | 333/6 |
| 3,501,738 | 3/1970 | Tolliver | 439/581 |
| 3,675,181 | 7/1972 | Lankford et al. | 439/581 |
| 3,895,318 | 7/1975 | Ross | 333/6 |
| 3,983,457 | 9/1976 | Smith | 439/581 |
| 4,270,214 | 5/1981 | Davis et al. | 455/80 |
| 4,394,631 | 7/1983 | Pavlic | 333/132 |
| 4,481,641 | 11/1984 | Gable et al. | 375/7 |
| 5,281,933 | 1/1994 | Chamberlin | 333/132 |

*Primary Examiner*—David L. Pirlot
*Attorney, Agent, or Firm*—Richards, Medlock & Andrews

[57] ABSTRACT

Line power voltage is taken from a cable system tap module by a device having a housing, first and second electrical insulators coaxially positioned within first and second cavities in the housing, a contact tip member positioned in the first insulator and having a tip end portion extending through an opening in an end of the housing, and a hollow screw employed as a seizure screw in the tap module. The hollow screw has a hollow with a contact socket positioned therein for resiliently receiving the tip end portion of the contact tip member so as to provide a longitudinally sliding electrical connection between the contact tip member and the hollow screw. An inductance coil is positioned within an axial bore of the second insulator. The external dimensions of the first and second insulators correspond to the dimensions of the first and second cavities so that the inductance coil and the contact tip member are accurately positioned within the housing. A power take-off cable has a first lead connected to the housing, and a second lead connected through a high frequency filter to the contact tip member. The external surface of the housing provides a gripping surface.

20 Claims, 4 Drawing Sheets

CATV POWER TAPPING DEVICE

FIELD OF THE INVENTION

This invention relates to a device for tapping the power of a cable system, and more particularly of tapping the line power voltage of a coaxial cable television distribution system.

BACKGROUND OF THE INVENTION

A cable television distribution system generally transmits both a line power voltage and high frequency television signals through the same coaxial cable line. The line power voltage, which can be a square wave direct current voltage, is utilized to provide power to the line amplifiers, which are located at intervals along a cable line, for maintaining the strength of the high frequency signals being transmitted through the cable line.

A take-off connection for the high frequency signals can be accomplished through the utilization of a directional coupler module or a tap module. The primary purpose of a directional coupler module or a tap module is to provide a take off of the high frequency signals. A commonly employed directional coupler module, which can be viewed as a Y connection for the radio frequency television signals, has a pair of inlet ports, a pair of outlet ports, a pair of drop/tap ports, and a pair of dummy ports. An inlet cable can be connected to one of the pair of inlet ports, with the other inlet port having a removable cap so as to serve as an access port for the installation of the inlet cable in the first inlet port. Similarly, an outlet cable can be connected to one of the pair of outlet ports with the other outlet port having a removable cap so as to serve as an access port for the installation of the outlet cable in the first outlet port. Each of the dummy ports is provided with a removable cap. A secondary output cable can be connected to one of the pair of drop/tap ports, with the other of the pair of drop/tap ports serving as an access port for the installation of the secondary output cable in the first drop/tap port. A commonly employed tap module has a pair of inlet ports, a pair of outlet ports, and one or more customer drop ports. One of the inlet ports and one of the outlet ports serve as access ports for the installation of the inlet cable and the outlet cable in the other inlet port and the other outlet port, respectively. Basically, the tap modules are passive devices for eliminating the line power voltage from the signals being applied to the customer drop ports.

However, recent developments in cable television distribution systems provide for equipment, requiring a power supply, to be installed at the tap module, such as scrambling/unscrambling devices and devices for preventing unauthorized transmission of the radio frequency television signals. Such additional devices need to be able to utilize the line power voltage that is carried by the cable, without adversely impacting the radio frequency television signals.

SUMMARY OF THE INVENTION

The present invention provides a power take-off device which can be employed to take-off line power voltage from a cable system which includes a module connected for tapping off high frequency signals, where the module has first and second electrical contacts, first and second input ports, and first and second output ports. The input cable can be connected to the first input port with a conductor of the input cable being secured to the first electrical contact of the module by a first seizure screw, which is accessible through the second input port. The output cable can be connected to the first output port with a conductor of the output cable being secured to the second electrical contact of the module by a second seizure screw, which is accessible through the second output port. In accordance with the present invention, the power take-off device comprises:

- an electrically conductive housing having a first end thereof adapted to engage one of the second input port and the second output port, the housing having a cavity formed therein with this cavity including an opening in the first end of the housing;
- a first electrical insulator positioned within the cavity in the housing;
- a contact tip member positioned in the first insulator so as to be electrically insulated from the housing and having a tip end portion extending through the opening in the first end of the housing; and
- a hollow seizure screw to be employed as the one of the first and second seizure screws which is accessible through said one of the second input port and the second output port, the hollow screw having a hollow therein for receiving the tip end portion of the contact tip member so as to provide a longitudinally sliding electrical connection between the contact tip member and the hollow screw in order to thereby provide an electrical connection between the contact tip member and the one of the first and second electrical contacts which is engaged by the hollow screw.

In a presently preferred embodiment of the invention, the hollow screw has a head end and a threaded end portion, with the hollow in the hollow screw extending along the longitudinal axis of the hollow screw from an opening in the head end. A contact socket can be positioned within the hollow of the hollow screw so as to resiliently grip the tip end portion of the contact tip member. The cavity in the housing comprises first, second, and third cavities, with the first insulator being positioned in the first cavity, a second insulator being positioned in the second cavity, and a cover plate being positioned in the third cavity. An inductance coil can be positioned within a bore in the second insulator. The external dimensions of the first and second insulators at least substantially correspond to the dimensions of the respective cavity so that the inductance coil and the contact tip member are accurately positioned within the housing. A power take-off cable can have a first lead connected to the housing, and a second lead connected through a high frequency filter to the contact tip member. The external surface of the housing can be configured to provide an external gripping surface.

DETAILED DESCRIPTION

Figure 1:
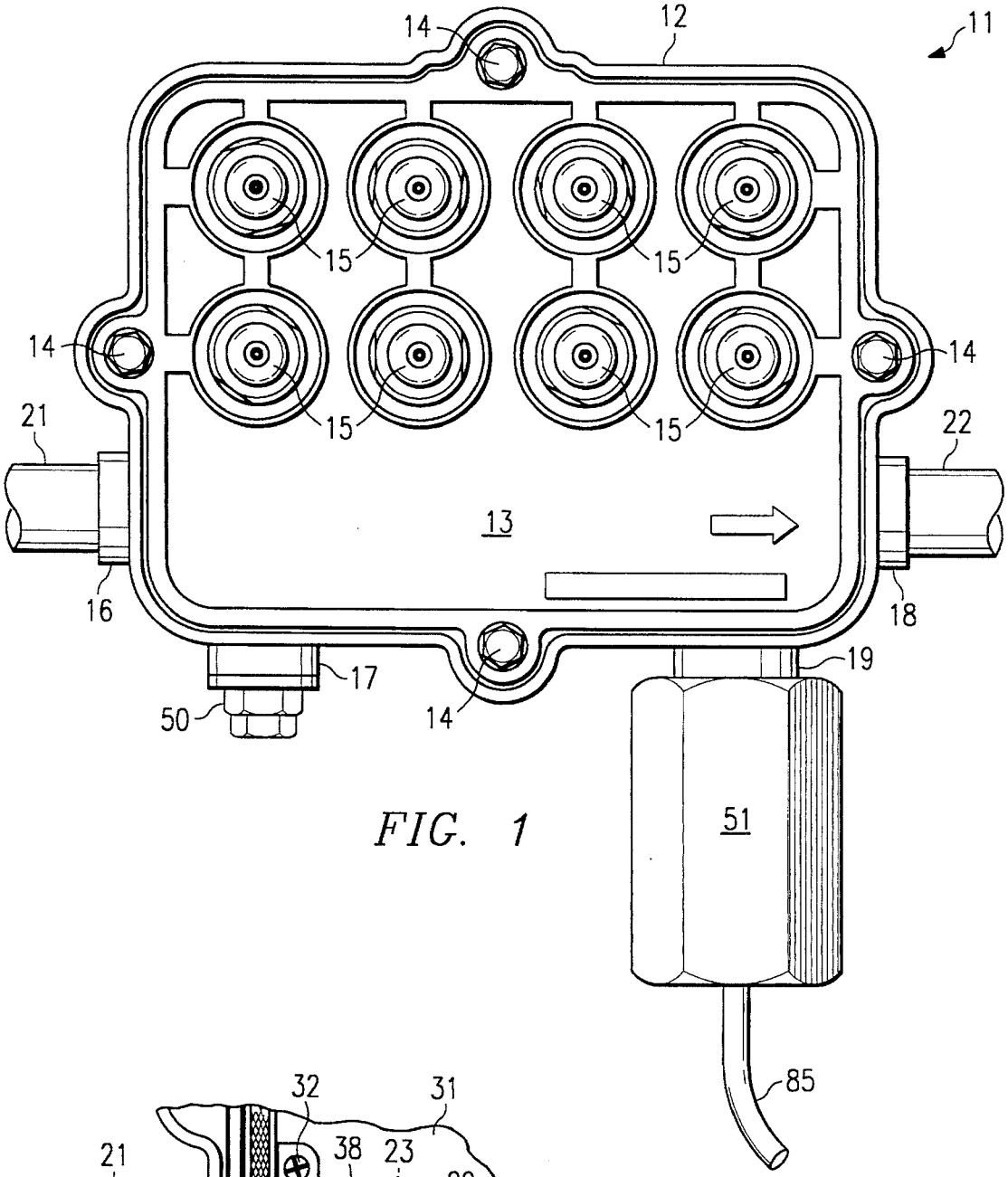
FIG. 1 is a plan view of a tap unit having an input cable connected to one of the two input ports, an output cable connected to a first one of the two output ports, and a power tapping device in accordance with the present invention connected to the second one of the output ports.

Referring now to FIG. 1, a tap unit 11 comprises a bowl shaped body 12 and a cover 13, each being formed of metal or other suitable electrically conductive material. The cover 13, which is secured to the body 12 by four screws 14, is provided with a plurality of taps 15 for connection of coaxial cables leading to individual customer installations. The lower left corner (as viewed in FIG. 1) of the body 12 serves as the input corner and has input ports 16 and 17, while the lower right corner of the body 12 serves as the output corner and has output ports 18 and 19. An input cable 21 is connected to input port 16, while an output cable 22 is connected to output port 18.

Figure 2:
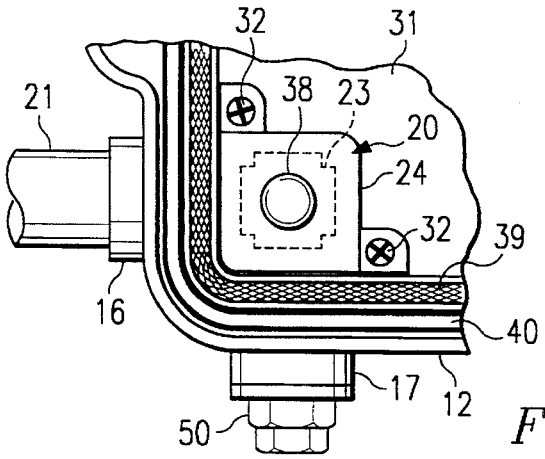
FIG. 2 is a detail view of the input corner of the tap unit of FIG. 1 with the cover removed.
Figure 4:
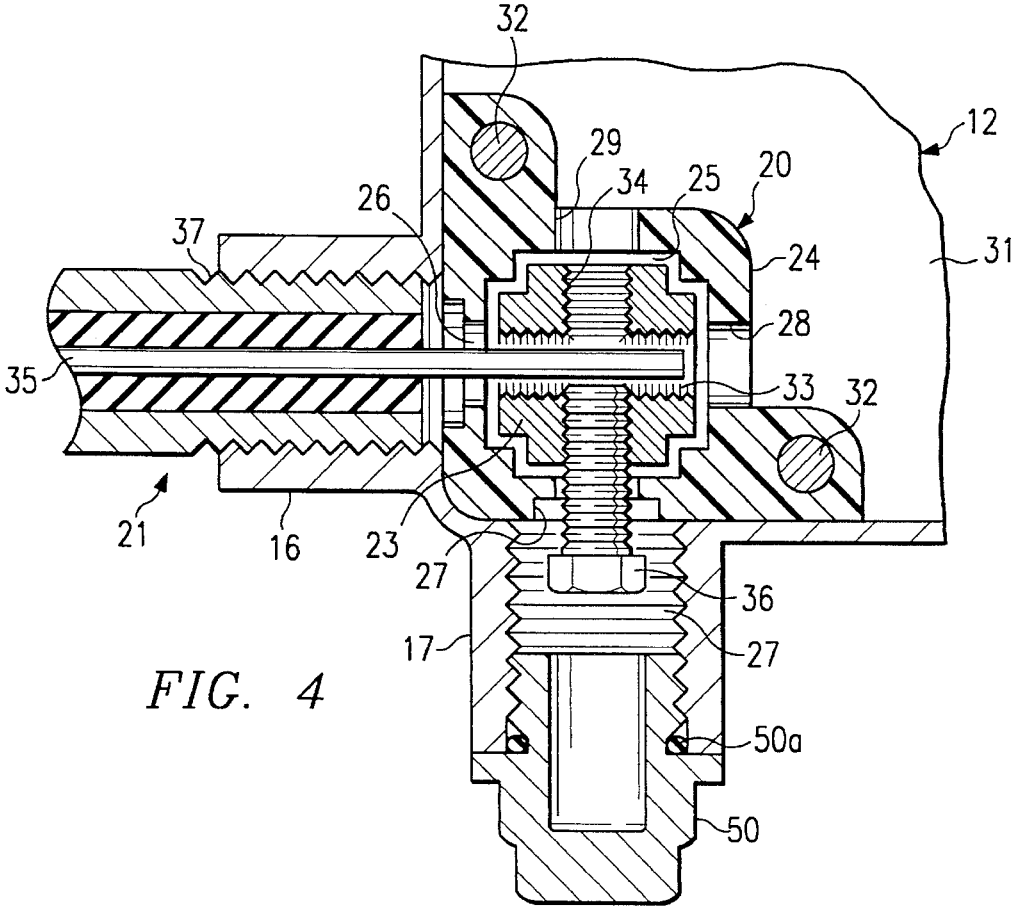
FIG. 4 is a detail cross-sectional view of the input corner of the tap unit of FIG. 1.

Referring now to FIGS. 2 and 4, the input ports 16 and 17 provide access to two adjacent sides of an input terminal unit 20, which comprises an electrically conductive contact member 23 contained within a central chamber 25 of a connector housing 24. The connector housing 24 is formed of electrically insulating material and has four openings 26, 27, 28, and 29 which provide communication from the central chamber 25 to each of the four exterior sides of the connector housing 24. The openings 26 and 28 are in axial alignment with each other, while the openings 27 and 29 are in axial alignment with each other, with the axis of the openings 26 and 28 being perpendicular to the axis of the openings 27 and 29. The connector housing 24 is secured to the bottom wall 31 of the body 12 by screws 32 so that the opening 26 in the connector housing 24 provides access between the inlet port 16 and the side of the contact member 23 adjacent thereto, while the opening 27 in the connector housing 24 provides access between the inlet port 17 and the side of the contact member 23 adjacent thereto. The contact member 23 is provided with a first threaded opening 33 therethrough which is coaxial with the openings 26 and 28, and a second threaded opening 34 therethrough which is coaxial with the openings 27 and 29, so that the threaded openings 33 and 34 intersect each other at right angles.

When, as shown in FIGS. 2 and 4, the input cable 21 is connected to the input port 16, the core conductor 35 of the input cable 21 is extended through the opening 26 of the connector housing 24 and along the threaded opening 33 past the intersection of the openings 33 and 34, and a seizure screw 36 is inserted through the opening 27 of the connector housing 24 into threaded engagement with the opening 34 of the contact member 23 so as to provide a firm electrical contact between the contact member 23 and the core conductor 35. The outer conductor 37 of the input cable 21 is electrically connected to the tap body 12.

The contact member 23 is provided with an electrically conductive post 38 which extends outwardly from the connector housing 24 for providing a non-ground electrical connection to an electronic circuit board (not shown) which is mounted on the underside of cover 13 and provides high frequency signals to taps 15. A strand of wire mesh 39 can be located in an annular groove in the lip of the bowl 12 to provide an electrical connection between the bowl 12, the cover 13, and the ground terminal of the electronic circuit board. A resilient gasket 40 can be provided in a second annular groove in the lip of the bowl 12 outwardly of the wire mesh strand 39 to physically protect the interior of the tap unit 11 against intrusion of moisture and dust. The dimensions of the contact member 23 are slightly smaller than the corresponding dimensions of the central chamber 25 in order to permit the post 38 to adjust to engagement with the cooperating contact on the circuit board during assembly of the cover 13 onto the body 12. After the seizure screw 36 has been adjusted to grip the core conductor 35 of the input cable 21, a plug 50 is joined to input port 17, as by threaded engagement, to protect the interior of the tap unit 11. An O-ring 50*a* can be provided between plug 50 and inlet port 17 to improve the sealing of the port 17.

Although either of inlet ports 16 and 17 can be utilized as the connection point for the input cable 21 by the proper positioning of the seizure screw 36 in alignment with the other of the ports 16 and 17, only one of the ports 16 and 17 can be connected to an input cable as the other one must serve as the access port for the manipulation of the seizure screw 36.

Figure 3:
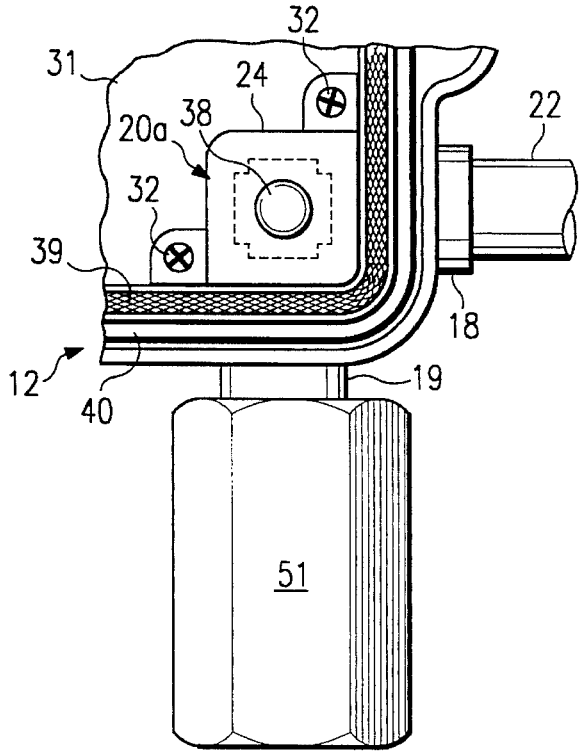
FIG. 3 is a detail view of the output corner of the tap unit of FIG. 1 with the cover removed.
Figure 5:
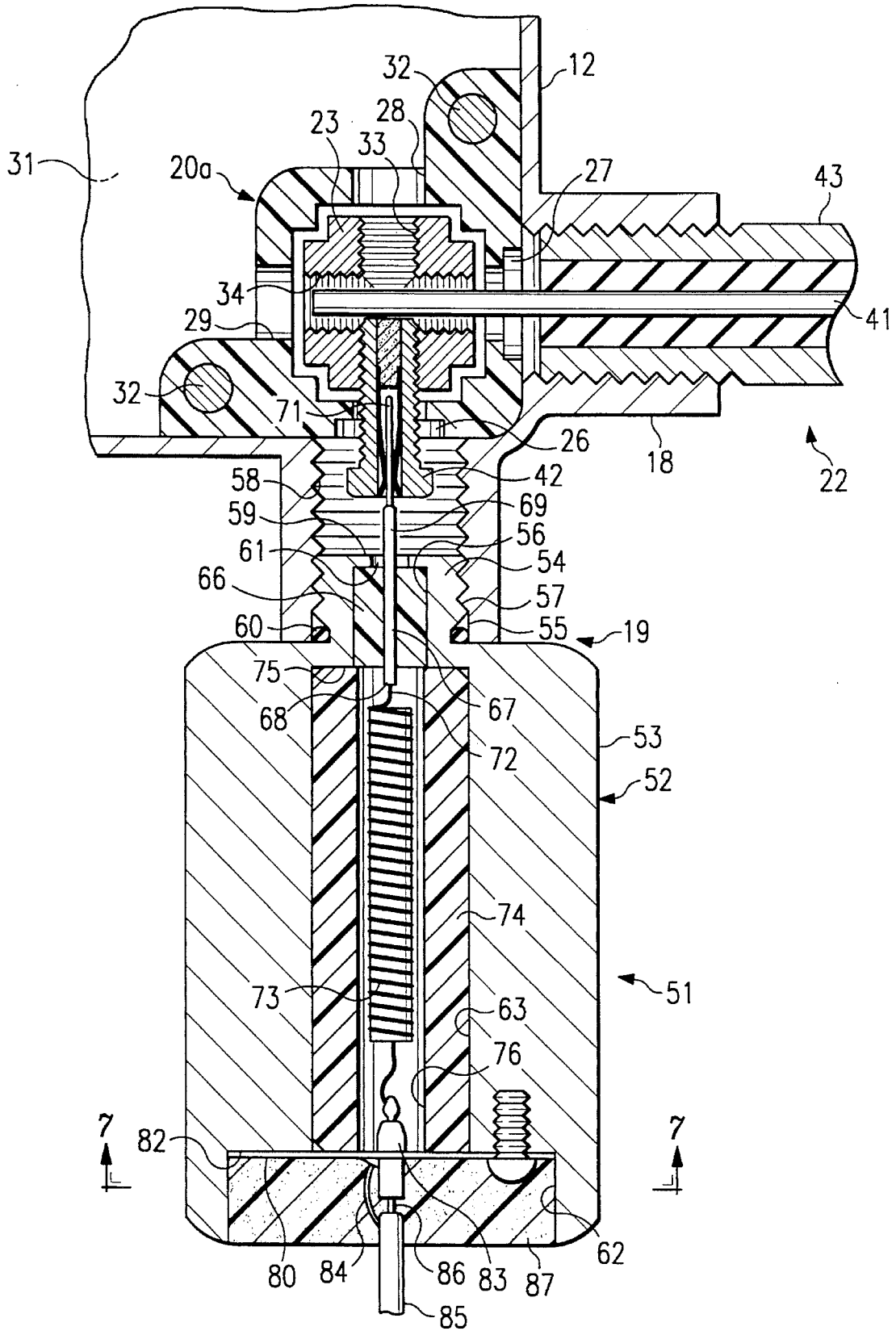
FIG. 5 is a detail cross-sectional view of the output corner of the tap unit of FIG. 1 and the power tapping device.

Referring now to FIGS. 3 and 5, the output ports 18 and 19 provide access to two adjacent sides of an output terminal unit 20*a*, which is identical to the input terminal unit 20 of FIGS. 2 and 4 when rotated 90° counterclockwise, except as to the construction of the seizure screw as will be discussed hereinafter. As components of the output terminal unit 20*a*, which are identical to components of the input terminal 20, are identified with the same reference characters, a detailed description of these components of the output terminal unit 20*a* is not repeated. The connector housing 24 of the output terminal unit 20*a* is secured to the bottom wall 31 of body 12 by screws 32 so that the opening 27 in the connector housing 24 of the output terminal unit 20*a* provides access between the outlet port 18 and the threaded opening 34 in the side of contact member 23 adjacent thereto, while the opening 26 in the connector housing 24 of the output terminal unit 20*a* provides access between the outlet port 19 and the opening 33 in the side of the contact member 23 adjacent thereto.

When, as shown in FIGS. 3 and 5, the output cable 22 is connected to the output port 18, the core conductor 41 of the output cable 22 is extended through opening 27 of the connector housing 24 and along the threaded opening 34 past the intersection of the openings 33 and 34, and a hollow seizure screw 42 is inserted through the opening 26 of the connector housing 24 into threaded engagement with the opening 33 of the contact member 23 so as to provide a firm electrical contact between the core conductor 41 and the contact member 23 of the output terminal unit 20*a*. The outer conductor 43 of the output cable 22 is electrically connected to the tap body 12.

Figure 6:
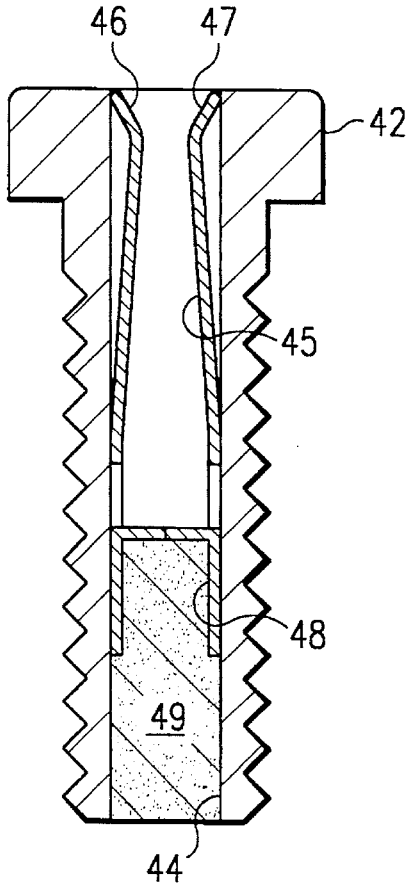
FIG. 6 is a cross-sectional view of a modified capture screw which forms a part of the power tapping device.
Figure 7:
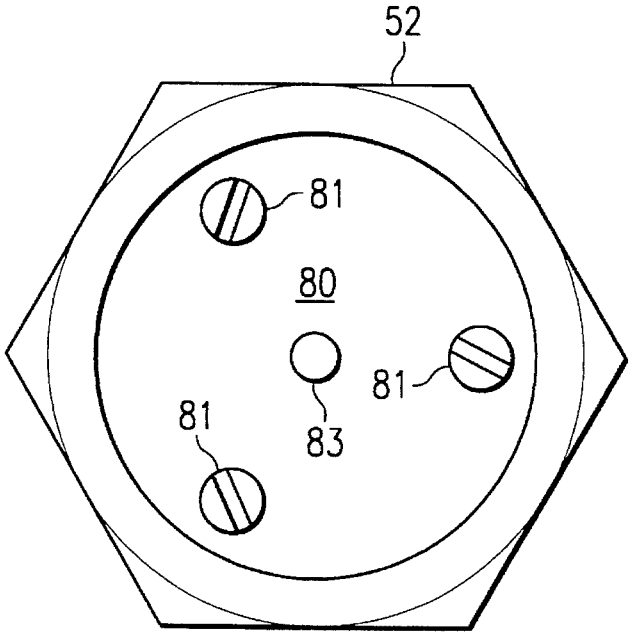
FIG. 7 is a cross-sectional view taken along line 7—7 of FIG. 5.

As shown in FIG. 6, the hollow seizure screw 42 is formed with an elongated cylindrical cavity 44 extending along the longitudinal axis of the screw from an opening in its hex head end to an opening in its threaded end. A socket contact 45, having two spring fingers 46 and 47 at one end and a solder cup 48 at its other end, is positioned within the cylindrical cavity 44 with the distal ends of the spring fingers 46 and 47 being at least substantially flush with the hex head end of the screw 42. The portion of the cylindrical cavity 44 remote from the hex head end of the screw 42 and including the solder cup 48 can be filled with solder 49 to secure the socket contact 45 in place in the seizure screw 42. When the socket contact 45 is too long for the seizure screw 42, a part of or all of the solder cup end 48 of the socket contact 45 can be removed. While any suitable socket contact can be employed, the presently preferred socket contact is the Amp part number 66569-8, manufactured by AMP, Inc. When the socket contact 45 has a lower section with an enlarged diameter, the socket contact 45 can be secured to the screw 42 by a press fit of the enlarged diameter portion of the socket contact with the interior wall of the cylindrical cavity 44.

Referring now to FIG. 5, the power tapping device 51 has an electrically conductive housing 52 comprising a major body portion 53 and a minor body portion 54. The longitudinally extending exterior surface of the major body portion 53 is in the form of six planar surfaces extending parallel to the longitudinal axis of the power tapping device 51 and joined together so that the major body portion 53 has a hexagonal external shape when viewed as a cross-section perpendicular to its longitudinal axis. The hexagonal external shape of the housing 52 provides a gripping surface which facilitates a manual attachment of the power tap unit 51 to the tap unit 11 without the necessity of using a wrench.

The minor body portion 54 is coaxial with the major body portion 53 and extends from one end of the major body portion 53 as an annular wall 55 forming a cylindrical cavity 56 and having external threads 57 for mating with the internal threads 58 of the outlet port 19, with the distal end of the annular wall 55 having a radially inwardly directed flange 59 to form an orifice 61 having a diameter substantially smaller than the diameter of the cylindrical cavity 56. An O-ring 60 can be provided between housing 52 and outlet port 19 to improve the sealing of the port 19.

The end of the major body portion 53 remote from the minor body portion 54 has an outer cylindrical cavity 62 formed therein. The major body portion 53 has an elongated inner cylindrical cavity 63 formed therein extending from the outer cylindrical cavity 62 to the cylindrical cavity 56 in the minor body portion 54, with the diameter of the inner cylindrical cavity 63 being less than the diameter of the outer cylindrical cavity 62 and greater than the diameter of the cylindrical cavity 56.

A first annular electrically insulating member 66 is positioned within cavity 56, with the external dimensions of the electrically insulating member 66 at least substantially corresponding to the dimensions of the cavity 56, e.g., the external diameter of the cylindrically annular insulating member 66 being at least substantially equal to the diameter of the cylindrical cavity 56 and the longitudinal length of the cylindrical member 66 being at least substantially equal to the longitudinal length of the cylindrical cavity 56 so that one end of the cylindrical member 66 abuts against the internal flange 59. A contact tip member 67 is positioned coaxially within and securely held by the cylindrically annular insulating member 66 so that the contact tip member 67 is electrically insulated from housing 52, with a first inner end portion 68 of the contact tip member 67 extending into the inner cylindrical cavity 63 and the second outer end portion 69 of the contact tip member 67 extending through the orifice 61. The distal end portion of the second end portion 69 is in the form of an elongated contact pin 71 which extends coaxially with the minor body portion 54 so that when the power tap unit 51 is threadedly engaged with outlet port 19, a substantial portion of the length of the contact pin 71 slidingly enters the contact socket 45 (FIG. 6) along the longitudinal axis of the seizure screw 42 and is resiliently engaged by spring fingers 46 and 47 to provide a good electrical connection between contact tip member 67 and contact member 23 through the seizure screw 42. The distal end of the first inner end portion 68 of the contact tip member 67 is provided with a cavity into which one end 72 of a first lead of an inductance coil 73 is inserted and then soldered to the contact tip member 67.

A second cylindrically annular electrically insulating member 74 is positioned within inner cylindrical cavity 63, with the external dimensions of the electrically insulating member 74 at least substantially corresponding to the dimensions of the cavity 63, e.g., with the external diameter of the cylindrical member 74 being at least substantially equal to the diameter of the inner cylindrical cavity 63 and the longitudinal length of the cylindrical member 74 being at least substantially equal to the longitudinal length of the inner cylindrical cavity 63 so that one end of the cylindrical member 74 abuts against the annular shoulder 75 formed at the jointure of cavities 56 and 63. The cylindrical member 74 is provided with a coaxial elongated cylindrical cavity 76 extending the length of the cylindrical member 74, so that the first end portion 68 of the contact tip member 67 extends coaxially into one end of the elongated cylindrical cavity 76. The inductance coil 73 comprises electrical wire wound about an elongated ferrite core so that the diameter of the inductance coil 73 is equal to or only slightly smaller than the diameter of the elongated cylindrical cavity 76. If desired, the inductance coil 73 can include a shrink wrap film casing to hold the wound wire in place on the ferrite core. The selection of the internal diameter of the cylindrical cavity 76 to mate with the external diameter of the inductance coil 73 and the selection of the external diameter of the second cylindrical insulating member 74 to mate with the internal diameter of the inner cylindrical cavity 63 provide for a precise positioning of the inductance coil 73 with respect to the conductive housing 52.

The first and second electrically insulating members 66 and 74 are maintained securely in place by an electrically conductive disc or cover plate 80 which is positioned in outer cylindrical cavity 62 and secured by screws 81 to the annular shoulder 82 formed at the jointure of cavities 62 and 63. A high frequency filter 83, for example a miniature electromagnetic interference (EMI) ceramic filter such as part number 4101-002 manufactured by TUSONIX, is positioned in a centrally located opening in the disc 80 so that the RF filter 83 extends into one end of the elongated cylindrical cavity 76. The non-ground input lead of the RF filter 83 is connected to one end of the second lead of inductance coil 73, while the exterior casing of the RF filter 83 is soldered to the disc 80 and to one wire 84 of a power take-off cable 85. The second wire 86 of cable 85 is connected to the non-ground output lead of the RF filter 83. After the cable 85 has been connected to the power tap 51, the outer cylindrical cavity 62 can be filled with a suitable potting material 87 to provide mechanical strength to the connections to cable 85 and to provide electrical insulation for the non-ground outlet terminal of the RF filter 83. The RF filter 83 is a $\pi$ filter so that the inductance element in RF filter 83 is in series with the inductance coil 73 in the non-ground electrical line, while the capacitors of the $\pi$ filter are connected between the non-ground electrical line and ground, as represented by the disc 80 and housing 52. The combination of the RF filter 83 and the inductance coil 73 serves as a high frequency filter and is highly effective in preventing the passage of any high frequency signals from the tap unit 11 to the power take-off cable 85.

Although either of ports 18 and 19 can be utilized as the connection point for output cable 22 by the proper position of the seizure screw 45 in alignment with the other of ports 18 and 19, only one of the ports 18 and 19 can be connected to an output cable 22 as the other one must serve as the access port for manipulation of the seizure screw 45. However, in accordance with the present invention, the seizure screw 45 serves as a power take-off contact for the power tap unit 51 as well as a screw to provide an electrical connection for the inner conductor 41 to the circuit board of the tap unit 11. Thus, it is not necessary to redesign the tap unit 11 to provide an additional power take-off port for the power tap unit 51.

In one embodiment of the invention, the inductance coil 73 comprises approximately 16 inches of 24 awg coating wire forming 20 turns tightly wound around a ¼ inch diameter ferrite core (Fair-Rite part number 4061276011) having a length of 1 inch, with the wound wire and ferrite core being encased by a heat shrink tube. The initial and final turns of the coil 73 are secured to the ferrite core by a suitable instant bond adhesive and then the heat shrink tube is shrunk about the coil 73 over the full length of the ferrite core to securely hold all of the wire turns in place. The contact pin 67 is press fitted in the central bore of the insulator 66 by inserting the smaller diameter end of the contact pin 67 first, leaving approximately 0.09 inch of the end 68 exposed for connection to one end of inductance coil 73. After one end of the inductance coil 73 is soldered to the exposed end 68, the insulating sleeve 74 is slid over the inductance coil 73 until the sleeve 74 makes contact with the insulating sleeve 66. The diameter of the bore 75 in the insulating sleeve 74 is approximately 0,375 inch so that the inductance coil 73 fits snugly within the bore 75.

The RF filter 83 (Tusonix part number 4101-002) is inserted into the central hole in the disc 80 so that a flange on the RF filter 83 contacts the disc 80. Solder is then applied completely around the RF filter 83 to secure the RF filter 83 to the disc 80. The ground wire 84 of cable 85 is soldered to the solder joint between the RF filter 83 and the disc 80, while the wire 86 of cable 85 is soldered to the output terminal lead of the RF filter 83 as close to the RF filter 83 as possible, removing any excess terminal lead. The lead of the inductance coil 73 exposed beyond the end of the sleeve 74 is cut to leave approximately ⅜ inch beyond the end of the sleeve 74, and the input terminal of the RF filter 83 is then soldered to the exposed lead, with excess terminal lead being removed. The resulting assembly is inserted into the hollow of the housing 52 so that the end 69 of the contact pin 67 extends through the orifice 61. The outer diameter of the insulator 74 is approximately 0.74 inch, which is substantially equal to the approximately 0.75 inch diameter of the bore 63, while the outer diameter of the insulator 66 is approximately 0,435 inch which is substantially equal to the approximately 0.438 inch diameter of bore 56 so that the insulators 66 and 74 snugly fit within the corresponding cavities of housing 52. The axial length of insulator 66 is approximately 0.44 inch while the axial length of the cavity 56 is approximately 0.45 inch. The axial length of insulator 74 is approximately 1.56 inches while the axial length of the cavity 63 is approximately 1.56 inches. The disc 80 is rotated as necessary to align the screw holes in disc 80 with the screw holes in the housing 52, and self-tapping screws 81 are then applied to secure the assembly to the housing 52. Although the diameter of bore 62 is substantially greater than the diameter of the bore 63 which in turn is substantially greater than the diameter of bore 56, the lengths of insulator sleeves 66 and 74 are selected so that the length of insulator sleeve 66 is at least substantially equal to the axial length of bore 56 and the combined length of insulator sleeves 66 and 74 is at least substantially equal to the combined axial length of bores 56 and 63 so that the insulator sleeves 66 and 74 are held firmly between the disc 80 and the flange 59. After a continuity test is performed to check the power tap assembly, the cavity 62 can be filled with potting material 87, and the O-ring 60 can be mounted around the upper end of the threaded portion of the small housing portion 54. While the external dimensions of the seizure screw 42 will depend on the manufacturer's specifications for the particular unit to which the power tap 51 is being connected, the bore 44 can have a diameter of approximately 0.082 inch, so that an Amp part number 66569-8 socket contact can be press fitted within the bore 44.

Reasonable variations and modifications of the invention are possible within the scope of the foregoing description and the attached drawings. For example, while it is presently preferred that each of the cavities 56, 63 and 62 and each of insulators 66 and 74 be cylindrical, it is possible to utilize other configurations, e.g. having a rectangular or hexagonal cross-section viewed in a plane perpendicular to the longitudinal axis, so long as the dimensions of the insulator 66 or 74 perpendicular to the longitudinal axis mate sufficiently with the dimensions of the respective cavity perpendicular to the longitudinal axis such that the respective insulator is accurately positioned in the housing, thereby accurately positioning the contact tip member 67 and the inductance coil 73.

That which is claimed is:

1. A power take-off device for taking line power voltage from a cable system which includes a module connected for tapping off high frequency signals, said module having first and second electrical contacts, first and second input ports, and first and second output ports, whereby an input cable is connected to said first input port with a conductor of said input cable being secured to said first electrical contact of said module by a first seizure screw engaging said conductor of said input cable and said first electrical contact where said first seizure screw is accessed through said second input port and an output cable is connected to said first output port with a conductor of said output cable being secured to said second electrical contact of said module by a second seizure screw engaging said conductor of said output cable and said second electrical contact where said second seizure screw is accessed through said second output port; said power take-off device comprising:

an electrically conductive housing having one end thereof adapted to engage one of said second input port and said second output port, said housing having a cavity formed therein with said cavity including an opening in said one end of said housing;

a first electrically insulative member positioned within said cavity in said housing;

a contact tip member positioned in said first electrically insulative member so as to be electrically insulated from said housing and having a tip end portion extending through said opening in said one end of said housing; and a hollow seizure screw to be employed as the one of said first and second seizure screws which is accessible through said one of said second input port and said second output port, said hollow seizure screw having a hollow therein for receiving said tip end portion of said contact tip member so as to provide a longitudinally sliding electrical connection between said contact tip member and said hollow seizure screw in order to thereby provide an electrical connection between said contact tip member and the one of said first and second electrical contacts which is engaged by said hollow seizure screw.

2. A power take-off device in accordance with claim 1, further comprising a power take-off cable having first and second electrical leads, with said first electrical lead being connected to said housing, and a high frequency filter having a serial connection between said second electrical lead and said contact tip member.

3. A power take-off device in accordance with claim 1, wherein a portion of said housing is provided with an external gripping surface.

4. A power take-off device in accordance with claim 1, wherein said hollow seizure screw has a head end and a threaded end portion, wherein the hollow in said hollow seizure screw extends along the longitudinal axis of said hollow seizure screw from an opening in said head end.

5. A power take-off device in accordance with claim 4, further comprising a contact socket positioned within the hollow of said hollow seizure screw so as to resiliently grip the tip end portion of the contact tip member.

6. A power take-off device in accordance with claim 1, wherein said cavity in said housing comprises a first cavity and a second cavity, said second cavity having dimensions perpendicular to its longitudinal axis which are greater than the corresponding dimensions of said first cavity perpendicular to its longitudinal axis, said first electrically insulative member being positioned in said first cavity; and wherein said power take-off device further comprises a second electrically insulative member positioned in said second cavity, said second electrically insulative member having a bore therein receiving an inner end of said contact tip member, an inductance coil having a first lead and a second lead, said inductance coil being positioned in said bore with said first lead being connected to said inner end of said contact tip member, and a cover plate secured to said housing to retain said first and second electrically insulative members within said housing; wherein the outer dimensions of said first electrically insulative member at least substantially correspond to the dimensions of said first cavity, wherein the outer dimensions of said second electrically insulative member at least substantially correspond to the dimensions of said second cavity, and wherein the dimensions of said inductance coil perpendicular to a longitudinal axis of said bore at least substantially corresponds to the dimensions of said bore perpendicular to the longitudinal axis of said bore.

7. A power take-off device in accordance with claim 6, wherein said cavity in said housing comprises said first cavity, said second cavity, and a third cavity, said second cavity being located between and communicating with said first and third cavities, said third cavity having dimensions perpendicular to its longitudinal axis which are greater than the corresponding dimensions of said second cavity, and wherein said cover plate has dimensions perpendicular to the longitudinal axis of said third cavity which are greater than the corresponding dimensions of said second cavity and less than the corresponding dimensions of said third cavity and being positioned within said third cavity.

8. A power take-off device in accordance with claim 7, wherein said first and second electrically insulative members are positioned in said housing coaxially with said contact tip member.

9. A power take-off device in accordance with claim 8, further comprising a power take-off cable having first and second electrical leads, with said first electrical lead being connected to said cover plate, and a high frequency filter having a serial connection between said second electrical lead of said power take-off cable and said second lead of said inductance coil.

10. A power take-off device in accordance with claim 8, further comprising a contact socket positioned within the hollow of said hollow seizure screw so as to resiliently grip the tip end portion of the contact tip member.

11. A cable system which comprises:

a module for tapping off high frequency signals, said module having first and second electrical contacts, first and second input ports, and first and second output ports, an input cable connected to said first input port with a conductor of said input cable being secured to said first electrical contact of said module by a first seizure screw engaging said conductor of said input cable and said first electrical contact where said first seizure screw is accessed through said second input port;

an output cable connected to said first output port with a conductor of said output cable being secured to said second electrical contact of said module by a second seizure screw engaging said conductor of said output cable and said second electrical contact where said second seizure screw is accessed through said second output port; and a power take-off device comprising:

(a) an electrically conductive housing having one end thereof connected to one of said second input port and said second output port, said housing having a cavity formed therein with said cavity including an opening in said one end of said housing;

(b) a first electrically insulative member positioned within said cavity in said housing; and (c) a contact tip member positioned in said first electrically insulative member so as to be electrically insulated from said housing and having a tip end portion extending through said opening in said one end of said housing into contact with the one of said first and second seizure screws which is accessible through said one of said second input port and said second output port; and wherein said one of said first and second seizure screws, which is accessible through said one of said second input port and said second output port, is a hollow seizure screw, said hollow seizure screw having a hollow therein for receiving said tip end portion of said contact tip member so as to provide a longitudinally sliding electrical connection between said contact tip member and said hollow seizure screw in order to thereby provide an electrical connection between said contact tip member and the one of said first and second electrical contacts which is engaged by said hollow seizure screw.

12. A cable system in accordance with claim 11, wherein said hollow seizure screw has a head end and a threaded end portion, wherein the hollow in said hollow seizure screw extends along the longitudinal axis of said hollow seizure screw from an opening in said head end, and wherein said hollow seizure screw further comprises a contact socket positioned within the hollow of said hollow seizure screw so as to resiliently grip the tip end portion of the contact tip member.

13. A cable system in accordance with claim 12, further comprising a power take-off cable having first and second electrical leads, with said first electrical lead being connected to said housing, and a high frequency filter having a serial connection between said second electrical lead and said contact tip member.

14. A cable system in accordance with claim 11, wherein said cavity in said housing comprises a first cavity and a second cavity, said second cavity having dimensions perpendicular to its longitudinal axis which are greater than the corresponding dimensions of said first cavity perpendicular to its longitudinal axis, said first electrically insulative member being positioned in said first cavity; and wherein said power take-off device further comprises a second electrically insulative member positioned in said second cavity, said second electrically insulative member having a bore therein receiving an inner end of said contact tip member, an inductance coil having a first lead and a second lead, said inductance coil being positioned in said bore with said first lead being connected to said inner end of said contact tip member, and a cover plate secured to said housing to retain said first and second electrically insulative members within said housing; wherein the outer dimensions of said first electrically insulative member at least substantially correspond to the dimensions of said first cavity, wherein the outer dimensions of said second electrically insulative member at least substantially correspond to the dimensions of said second cavity, and wherein the dimensions of said inductance coil perpendicular to a longitudinal axis of said bore at least substantially correspond to the dimensions of said bore perpendicular to the longitudinal axis of said bore.

15. A cable system in accordance with claim 14, wherein said cavity in said housing comprises said first cavity, said second cavity, and a third cavity, said second cavity being located between and communicating with said first and third cavities, said third cavity having dimensions perpendicular to its longitudinal axis which are greater than the corresponding dimensions of said second cavity, and wherein said cover plate has dimensions perpendicular to the longitudinal axis of said third cavity which are greater than the corresponding dimensions of said second cavity and less than the corresponding dimensions of said third cavity and being positioned within said third cavity.

16. A power take-off device comprising:

an electrically conductive housing having a first end and a second end, said housing having a cavity formed therein with said cavity including an opening in said first end of said housing;

a first electrically insulative member positioned within said cavity in said housing;

a contact tip member positioned in said first electrically insulative member so as to be electrically insulated from said housing and having a tip end portion extending through said opening in said first end of said housing; and a hollow screw, said hollow screw having a hollow therein for receiving said tip end portion of said contact tip member so as to provide a longitudinally sliding electrical connection between said contact tip member and said hollow screw.

17. A power take-off device in accordance with claim 16, further comprising a contact socker positioned within the hollow of said hollow screw so as to resiliently grip the tip end portion of the contact tip member.

18. A power take-off device in accordance with claim 16, wherein said cavity in said housing comprises a first cavity and a second cavity, said second cavity having dimensions perpendicular to its longitudinal axis which are greater than the corresponding dimensions of said first cavity perpendicular to its longitudinal axis, said first electrically insulative member being positioned in said first cavity; and wherein said power take-off device further comprises a second electrically insulative member positioned in said second cavity, said second electrically insulative member having a bore therein receiving an inner end of said contact tip member, an inductance coil having a first lead and a second lead, said inductance coil being positioned in said bore with said first lead being connected to said inner end of said contact tip member, and an element secured to said housing to retain said first and second electrically insulative members within said housing; wherein the outer dimensions of said first electrically insulative member at least substantially correspond to the dimensions of said first cavity, wherein the outer dimensions of said second electrically insulative member at least substantially correspond to the dimensions of said second cavity, and wherein the dimensions of said inductance coil perpendicular to a longitudinal axis of said bore at least substantially correspond to the dimensions of said bore perpendicular to the longitudinal axis of said bore.

19. A power take-off device in accordance with claim 18, wherein said cavity in said housing comprises said first cavity, said second cavity, and a third cavity, said second cavity being located between and communicating with said first and third cavities, said third cavity having dimensions perpendicular to its longitudinal axis which are greater than the corresponding dimensions of said second cavity, and wherein said element has dimensions perpendicular to the longitudinal axis of said third cavity which are greater than the corresponding dimensions of said second cavity and less than the corresponding dimensions of said third cavity and being positioned within said third cavity.

20. A power take-off device in accordance with claim 19, wherein said element comprises a cover plate, and wherein said power take-off device further comprises a power take-off cable having first and second electrical leads, with said first electrical lead being connected to said cover plate, and a high frequency filter having a serial connection between said second electrical lead of said power take-off cable and said second lead of said inductance coil.

* * * * *